US008256022B2

(12) United States Patent
Bigalke

(10) Patent No.: US 8,256,022 B2
(45) Date of Patent: Sep. 4, 2012

(54) KNEE-MOUNTED AIR DEFLECTOR FOR MOTORCYCLIST

(76) Inventor: Jerry H. Bigalke, Stevens Point, WI (US)

( * ) Notice: Subject to any disclaimer, the term of this patent is extended or adjusted under 35 U.S.C. 154(b) by 285 days.

(21) Appl. No.: 12/587,813

(22) Filed: Oct. 14, 2009

(65) Prior Publication Data

US 2010/0096029 A1 Apr. 22, 2010

Related U.S. Application Data

(63) Continuation-in-part of application No. 12/288,244, filed on Oct. 17, 2008.

(51) Int. Cl.
*A41D 27/12* (2006.01)

(52) U.S. Cl. ..... 2/62; 2/22; 2/23

(58) Field of Classification Search ..... 2/22, 23, 2/24, 455, 242, 908, 911, 46, 62; 296/180.1, 296/78.1, 68.1, 77.1, 81, 82
See application file for complete search history.

(56) References Cited

U.S. PATENT DOCUMENTS

| | | | | |
|---|---|---|---|---|
| 3,901,549 | A * | 8/1975 | Ramirez | 296/78.1 |
| 4,457,552 | A | 7/1984 | Katsuoka | 296/78.1 |
| 5,452,475 | A * | 9/1995 | Hunt, Jr. | 2/22 |
| 5,469,637 | A * | 11/1995 | Adam | 36/2 R |
| 5,845,336 | A | 12/1998 | Golde | 2/93 |
| 6,102,149 | A | 8/2000 | Suzuki et al. | 180/229 |
| 6,263,510 | B1 | 7/2001 | Bay et al. | 2/93 |
| 7,178,858 | B1 | 2/2007 | Hesse | 296/180.1 |
| 2004/0244087 | A1 * | 12/2004 | Halterman | 2/15 |
| 2007/0066210 | A1 | 3/2007 | Ueda et al. | 454/125 |
| 2008/0222765 | A1 * | 9/2008 | Brandt | 2/22 |

* cited by examiner

*Primary Examiner* — Khoa Huynh
*Assistant Examiner* — Khaled Annis
(74) *Attorney, Agent, or Firm* — Patentability Associates

(57) ABSTRACT

An air deflector is mounted to the area of the knee of a motorcyclist to prevent a stream of air from striking the motorcyclist's face. In one embodiment, the deflector comprises a deflector plate and a mounting plate connected by a hinge mechanism. When the motorcycle is in motion, the air flow impacts the deflector plate, forcing the deflector to extend upward until a support web restrains the deflector plate.

11 Claims, 12 Drawing Sheets

KNEE-MOUNTED AIR DEFLECTOR FOR MOTORCYCLIST

CROSS-REFERENCE TO RELATED APPLICATION

This application is a continuation-in-part of application Ser. No. 12/288,244, filed Oct. 17, 2008, which is incorporated herein by reference in its entirety.

BACKGROUND OF THE INVENTION

A serious problem for motorcycles riders is that a blast of air impacts their neck, face and eyes while they are moving. This problem is illustrated in FIG. 1, which is a side view of a rider 10 on a motorcycle 12. As shown, an air stream 14 flows below the windshield 16, up the front side of the torso of rider 10 and hits the neck and face of rider 10. This air stream is annoying, particularly on long journeys. It is also noisy and may carry bugs and rain drops. Most importantly, the air stream presents a safety hazard, as it may distract the rider's attention from the road and from other vehicles.

U.S. Published Application No. 2004/0244087 suggests blocking this air stream with a deflector worn on the chest of the rider. This solution is not satisfactory, in part because a chest-worn deflector may impair the movement of the upper body and arms of the rider. In addition, the deflector cannot be easily removed and is unsightly. If mounted to a jacket, the jacket must be made of heavy material and fit tightly enough to hold the deflector in place during operation. This may be uncomfortable, particularly in warm weather.

BRIEF SUMMARY OF THE INVENTION

These problems are solved with a deflector of this invention. According to this invention, a forward-extending deflector is mounted to the area of the knees of the motorcycle rider. The deflector extends into the air stream and effectively prevents a large portion of the air stream from reaching the neck, face and eyes of the rider. The deflector of this invention does not interfere with the movement of the rider's arms and other upper body parts.

The deflector may be formed in a variety of sizes and shapes. In one embodiment, for example, the deflector is in the form of a visor of a cap. The deflector may be strapped to the legs of the rider. Typically, the deflector extends in a forward direction about 3-5 inches.

In another embodiment, the deflector is pivotally mounted to the rider's leg such that it is extended by the air flow when the cycle is in motion and collapses against the rider's leg when the cycle is stationary.

This invention also includes a method of blocking an air stream from the neck and face of a motorcycle rider by mounting a deflector to the rider's knees.

DETAILED DESCRIPTION OF THE INVENTION

Figure 1:
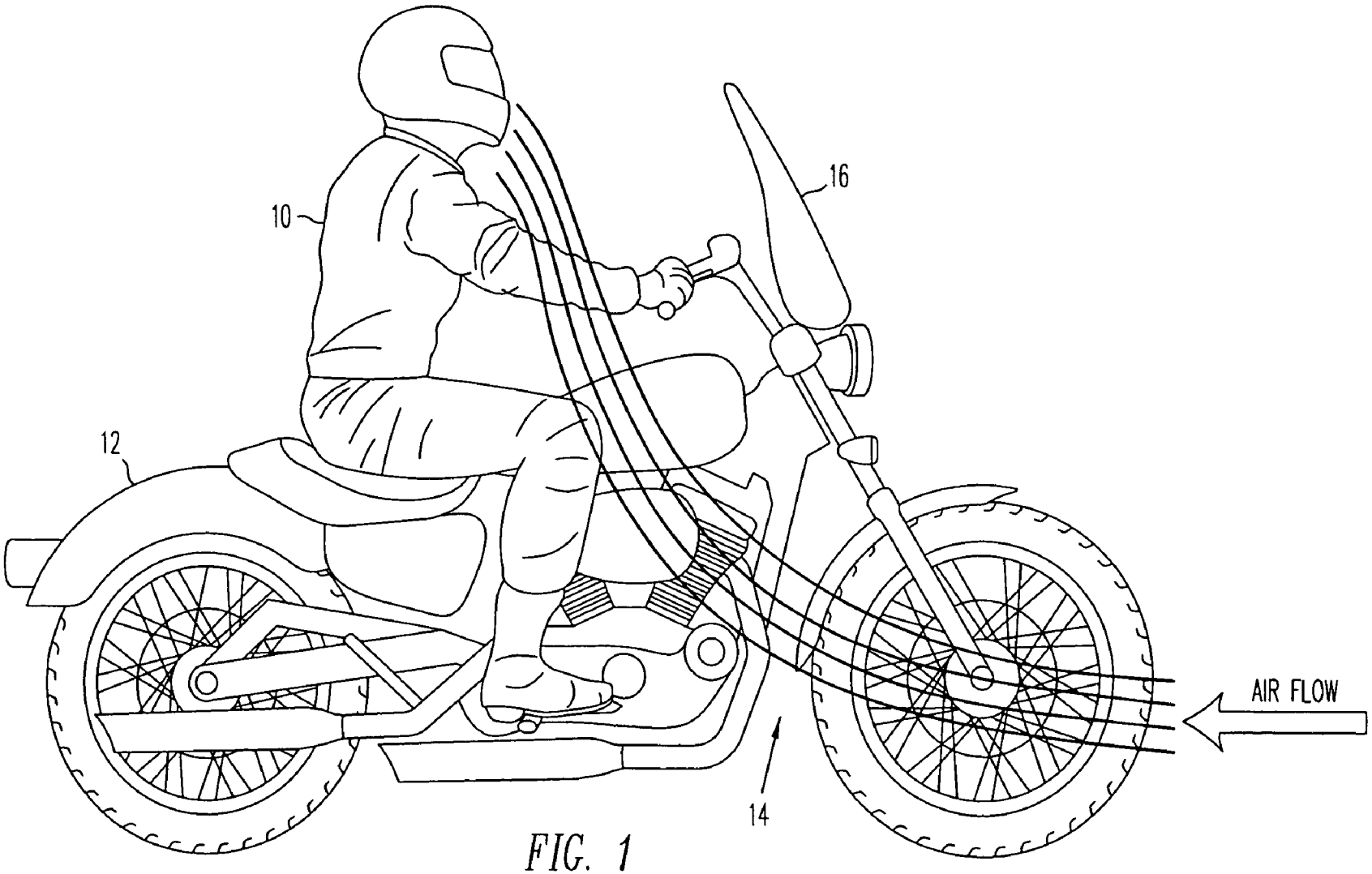
FIG. 1 (Prior Art)
FIG. 1 is side view illustrating how an air stream flows against the face and neck of a motorcycle rider.
Figure 2:
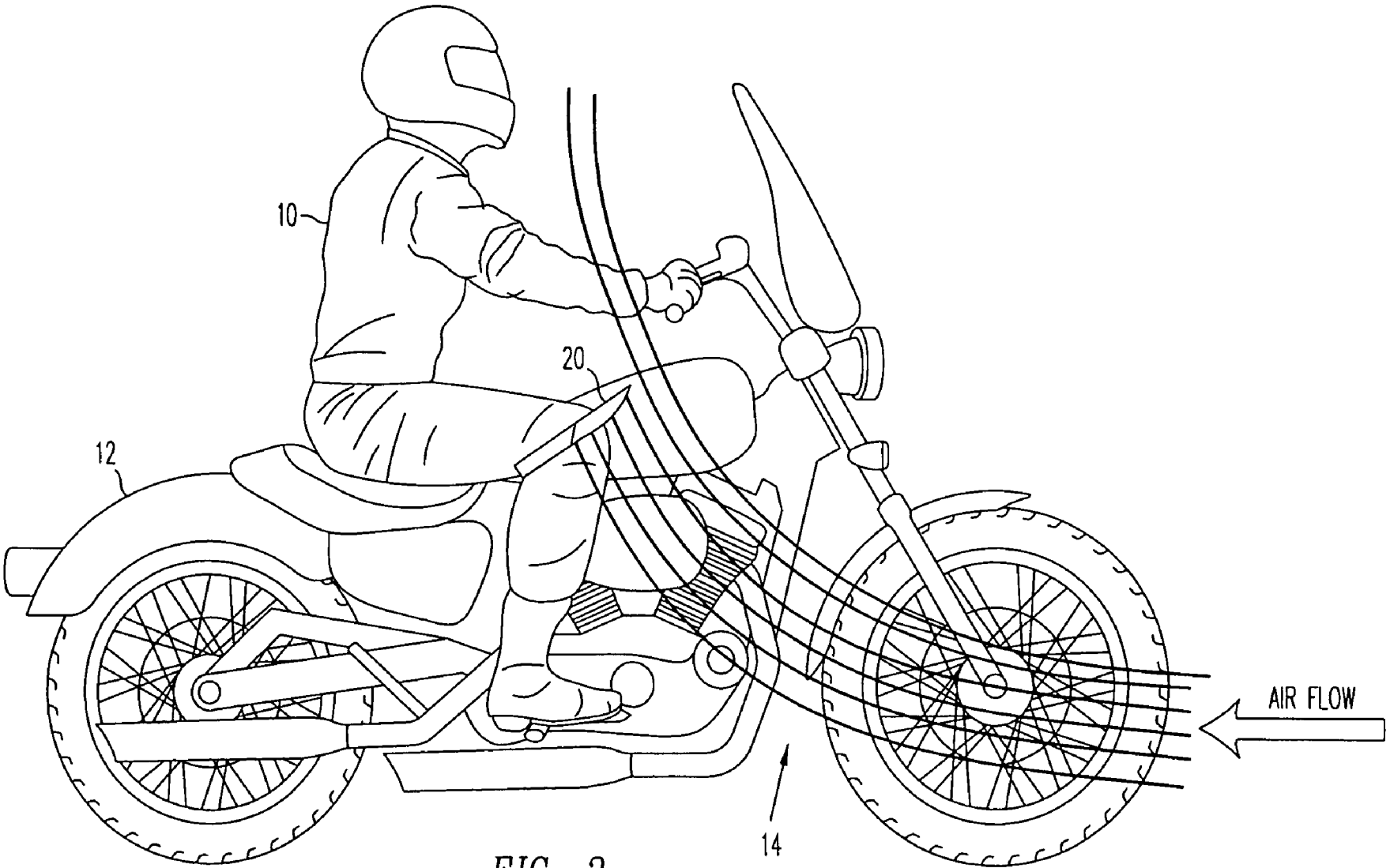
FIG. 2 is a side view of a deflector of this invention mounted to the knee of a motorcyclist.

FIG. 2 illustrates a deflector 20 of this invention. Deflector 20 is mounted to the knee of rider 10. As shown, deflector 20 extends into air stream 14 and prevents a large part of air stream 14 from impacting the neck and face of rider 10.

Figure 3:
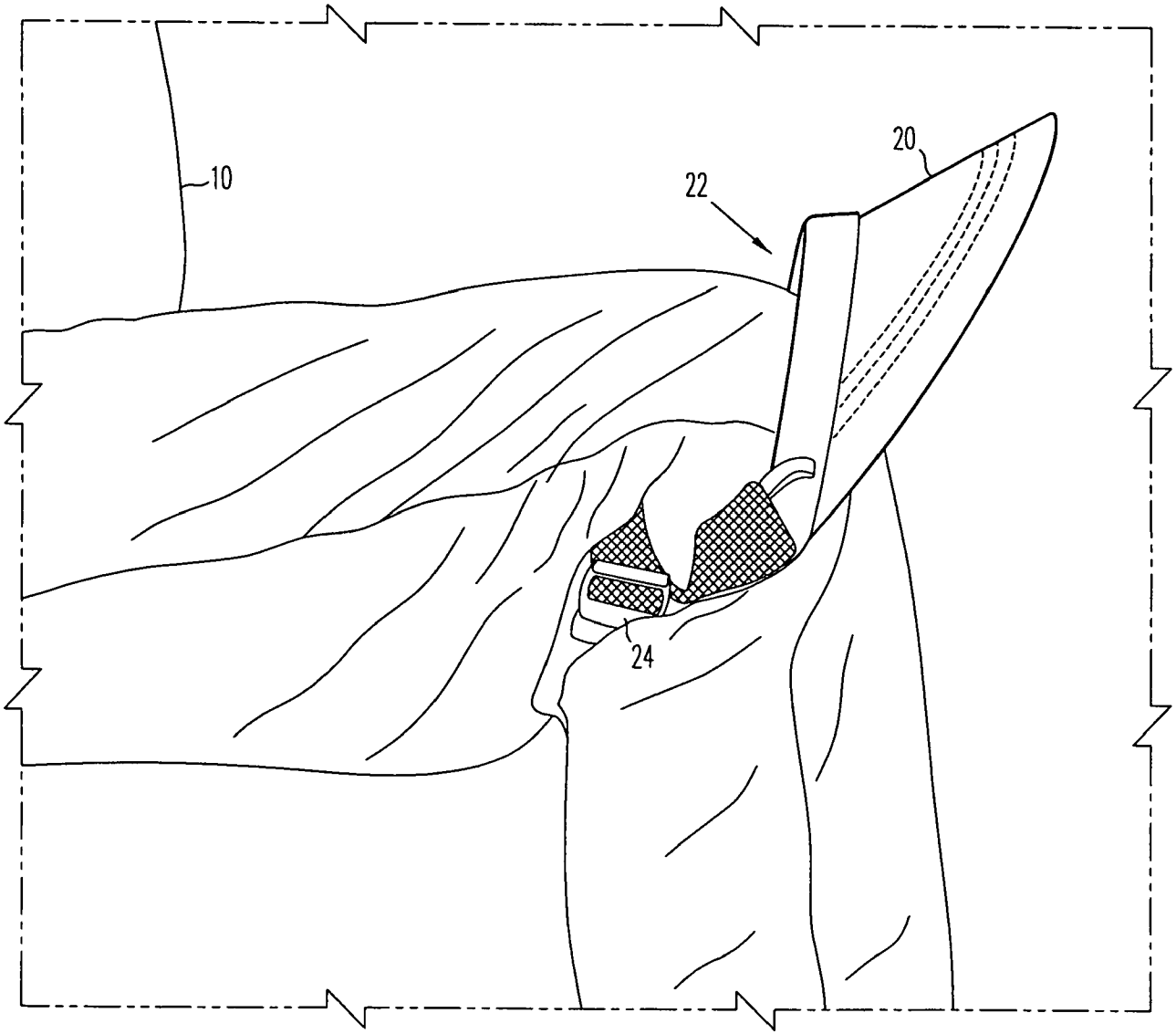
FIG. 3 is a close-up side view of the deflector mounted to the knee.
Figure 4:
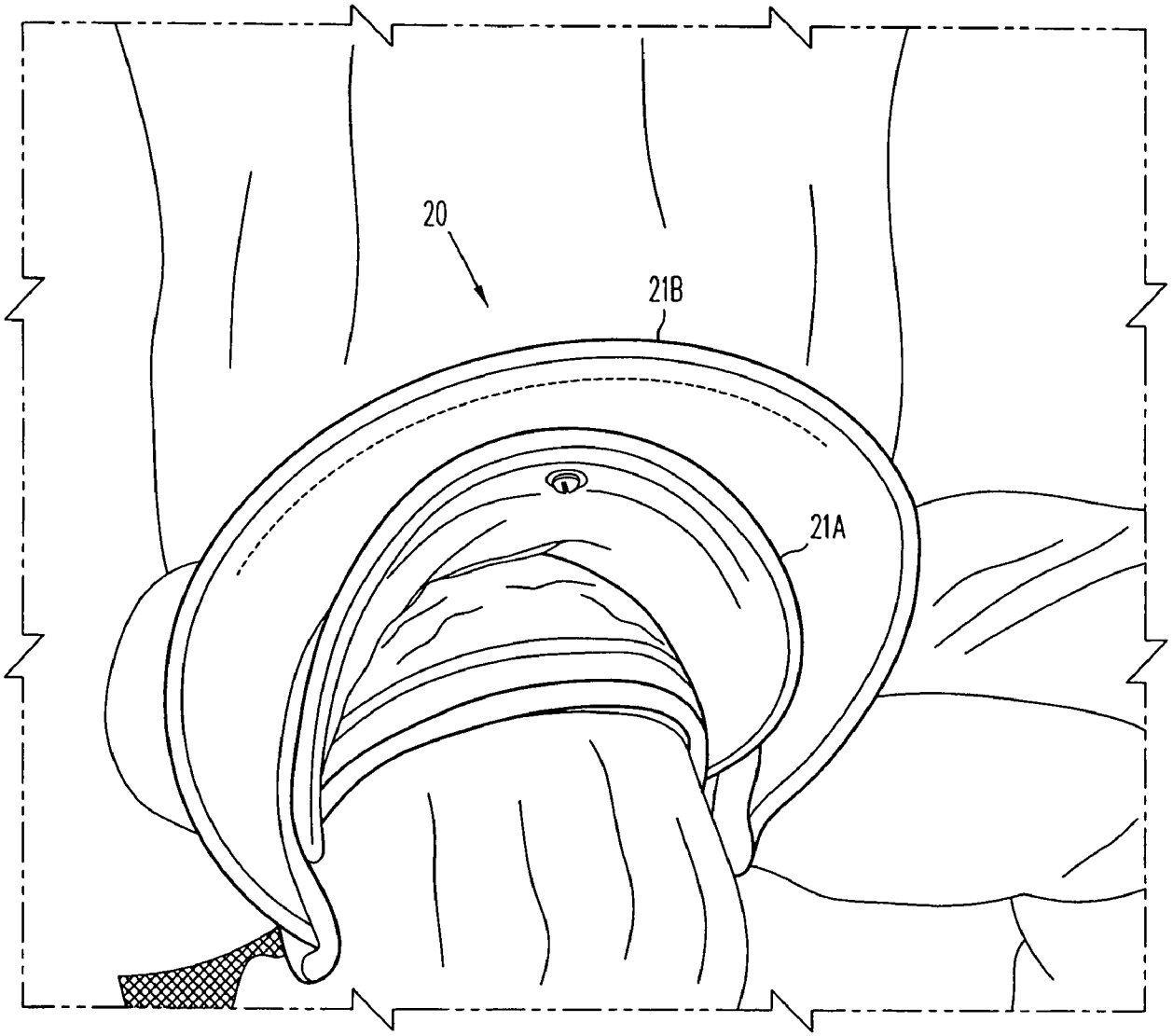
FIG. 4 is a close-up front view of the deflector mounted to the knee.

FIG. 3 is a more detailed view showing that deflector 20 is in the form of a cap visor and mounted to the knee 22 of rider 10 by means of a strap 24. FIG. 4 is a front view of the deflector 20 mounted to the rider's knee. Preferably, deflector 20 is mounted against the knee cap of rider 10 but it could also be mounted slightly above or slightly below the knee cap. As shown in FIG. 4, deflector 20 contains an inner cap visor 21A, which is fastened to the outer cap visor 21B in some manner (e.g., by stitching or gluing) to increase the extension of deflector 20, thereby allowing deflector 20 to block more air. The extension of deflector 20 in this embodiment is about 5 inches.

Figure 5:
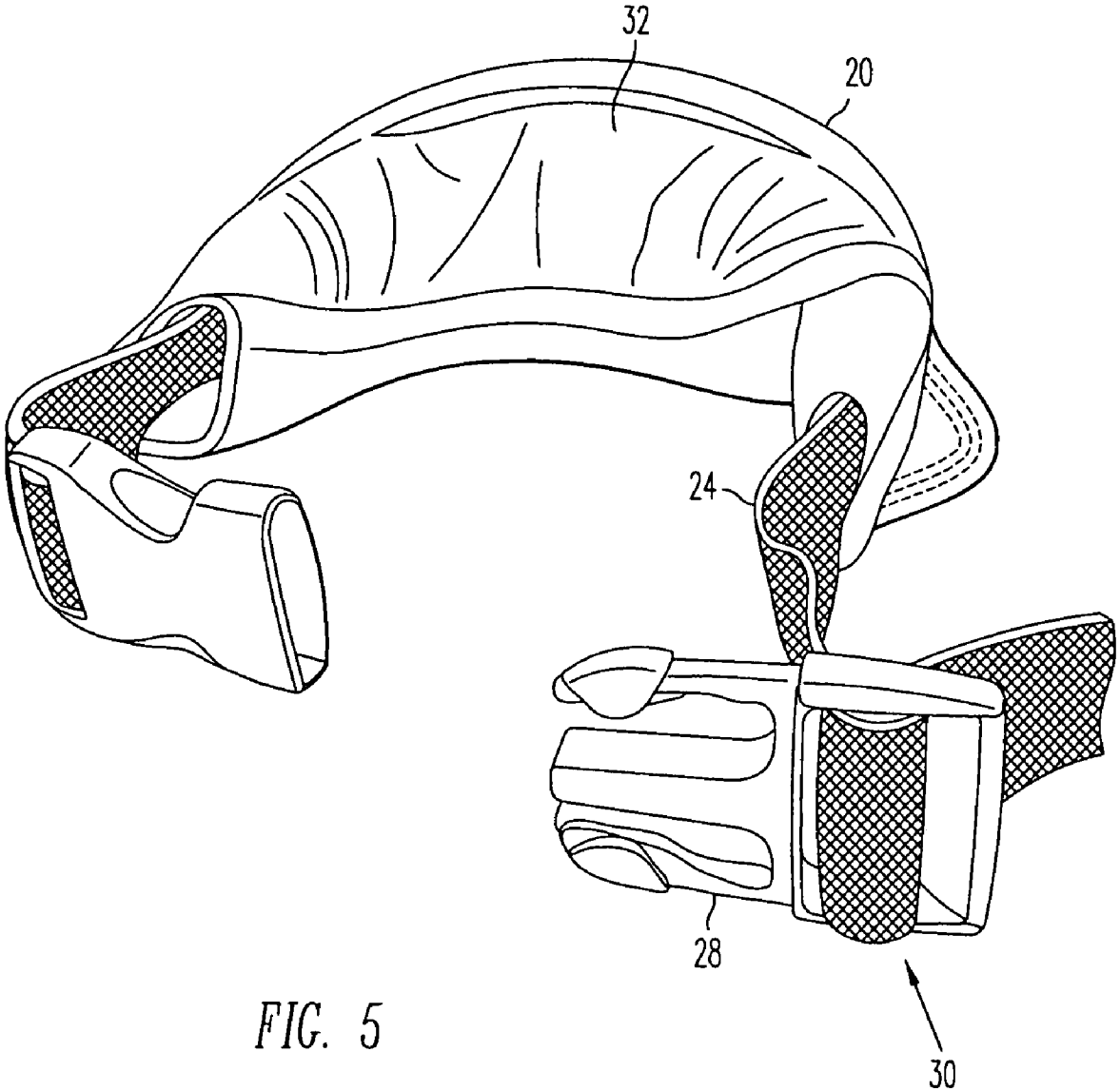
FIG. 5 is a detailed view of the defector showing the strap used to mount it to a knee.

FIG. 5 illustrates deflector 20 alone, showing strap 24 with a buckle 28, allowing deflector 20 to be easily mounted to and removed from the knee area of rider 10. As shown, strap 24 is looped back against itself through an opening 30 in buckle 28, making the length of strap 24 adjustable to fit the leg of the motorcyclist. Deflector 20 includes a mounting surface 32 which presses firmly against the knee of the motorcyclist when buckle 28 is secured.

Figure 6:
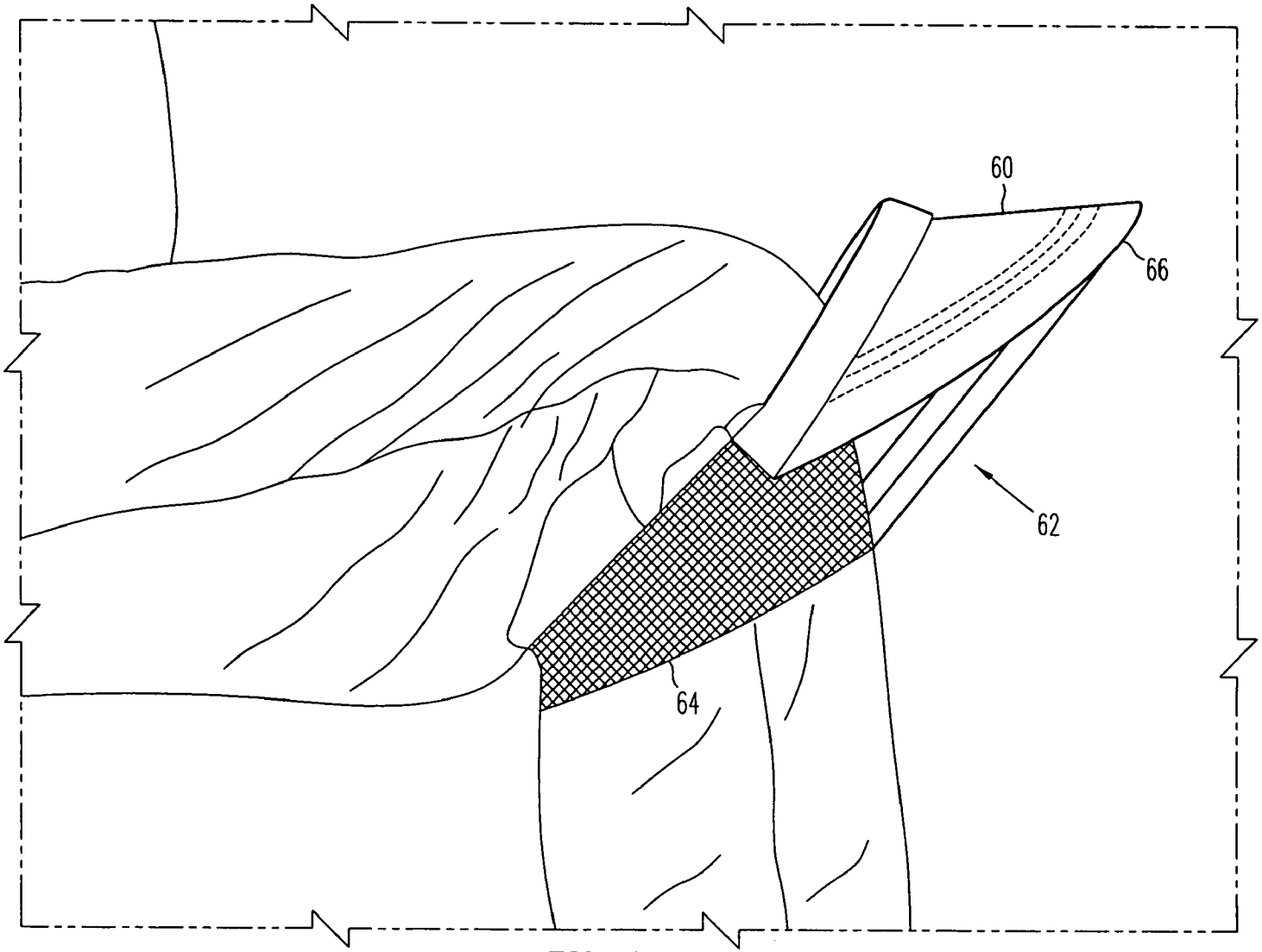
FIG. 6 is a close-up side view of the deflector with links to provide it with support against the air stream.

The defector 60 shown in FIG. 6 is similar to deflector 20 except that defector 60 contains links 62 extending from strap 64 to visor 66 to prevent visor 66 from being forced backward by the force of the air stream. Links 62 could be in the form of strings, elastic thread or a webbing.

Figure 7C:
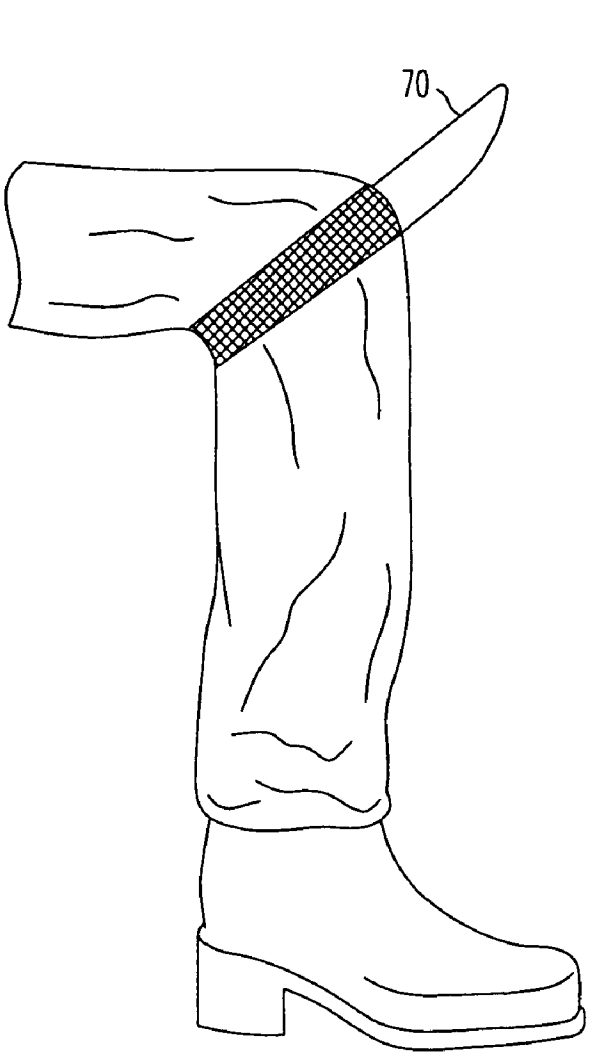
FIGS. 7A-7C illustrate a collapsible deflector that lies flat against the motorcyclist's leg when not in use.
Figure 7B:
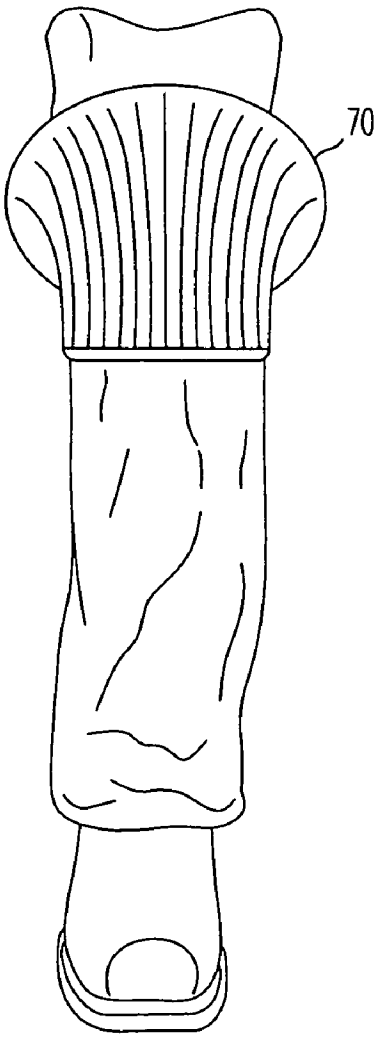
Figure 7A:
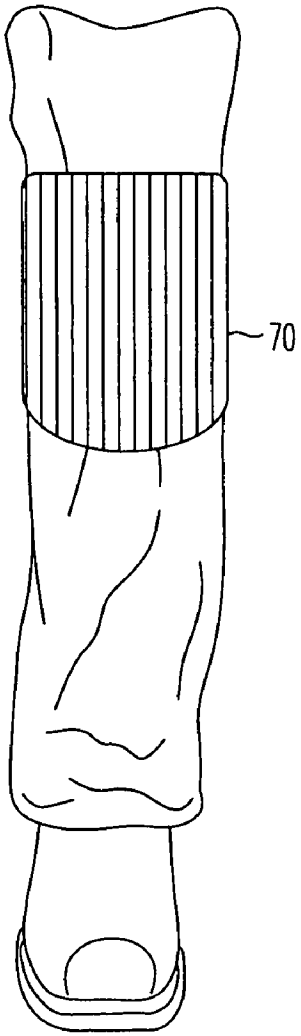

A possible problem with air deflectors is that they can be cumbersome and unsightly. FIGS. 7A, 7B and 7C illustrate a collapsible deflector 70. Deflector 70 is pleated so that it folds down against the leg of the rider when it is not being used to block an air stream. FIG. 7A shows deflector 70 in its collapsed condition, lying downward against the motorcyclist's leg. FIG. 7B is a front view of deflector 70 in its open condition when is it blocking an air stream. FIG. 7C is a side view of deflector 70 in its open condition.

Figure 8:
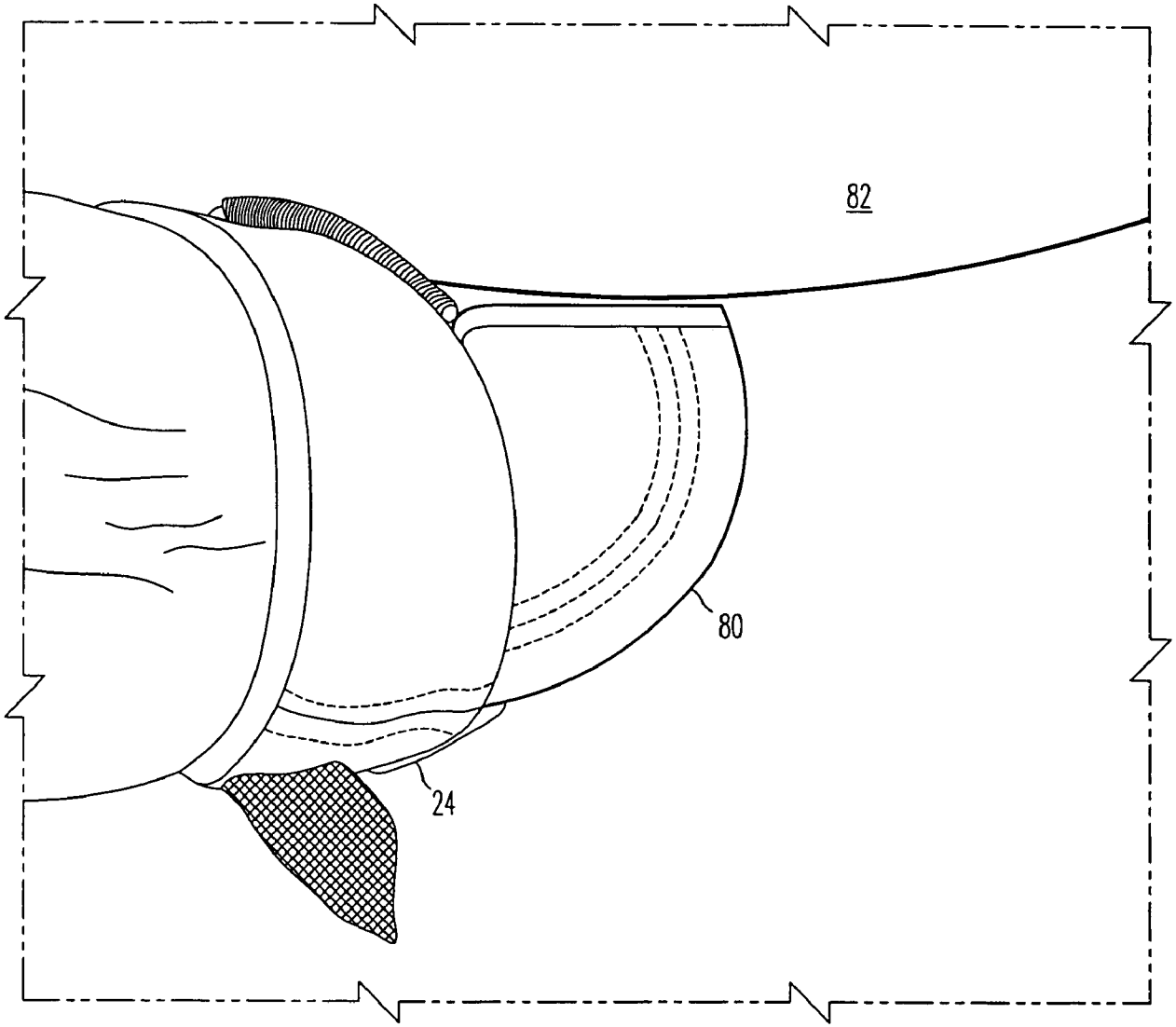
FIG. 8 is a top view of a deflector in the form of a half-visor.

FIG. 8 shows a top view of a deflector 80 that is in the shape of a half-visor, allowing deflector to fit snugly against the gas tank 82 and improving the efficiency of deflector 80 in blocking air. Typically, deflector 80 extends about 4 inches from the strap 24.

Figure 9B:
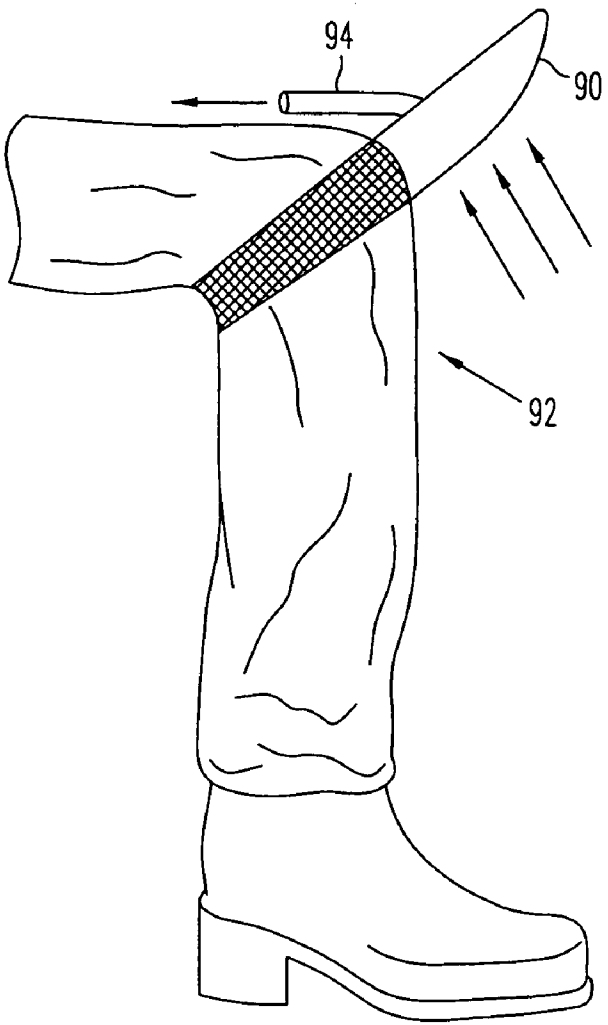
FIGS. 9A and 9B show a perforated deflector.
Figure 9A:
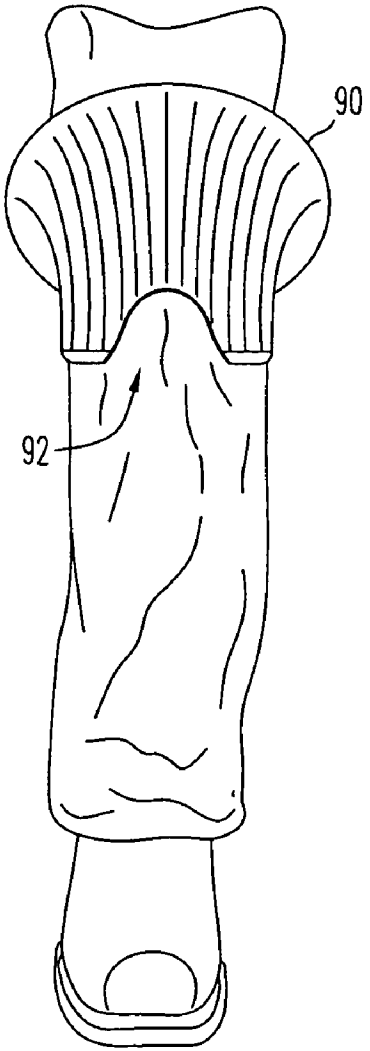

In some cases, it may be desirable to perforate the defector. FIGS. 9A and 9B illustrate deflector 90 that has a hole 92 adjacent the knee 22 of the rider. A tube 94 extends backward from hole 92 and to the side so as to direct the air that flows through hole 92 away from the face of the rider.

Figure 10:
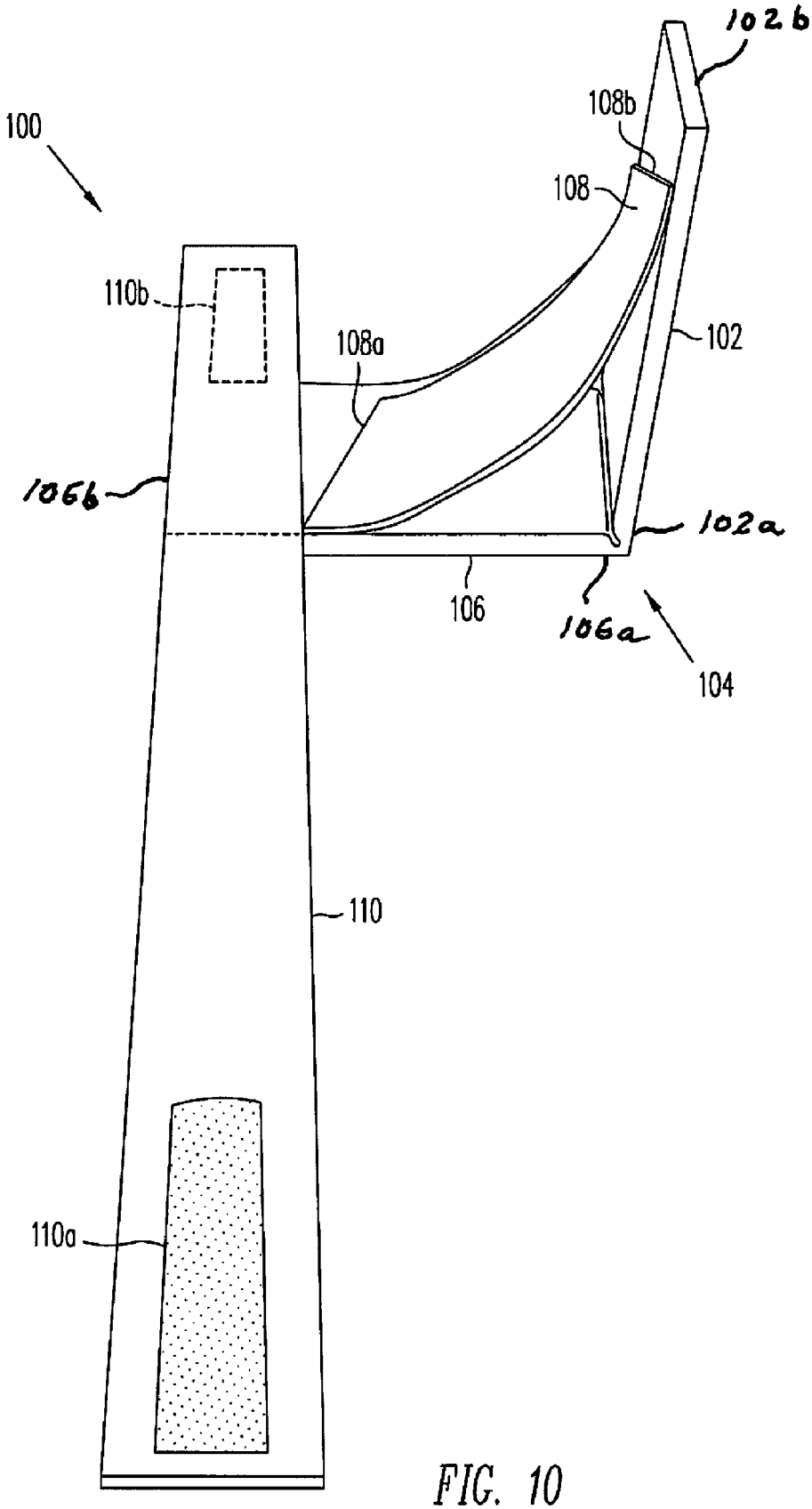
FIG. 10 is view of another embodiment according to the invention.
Figure 11:
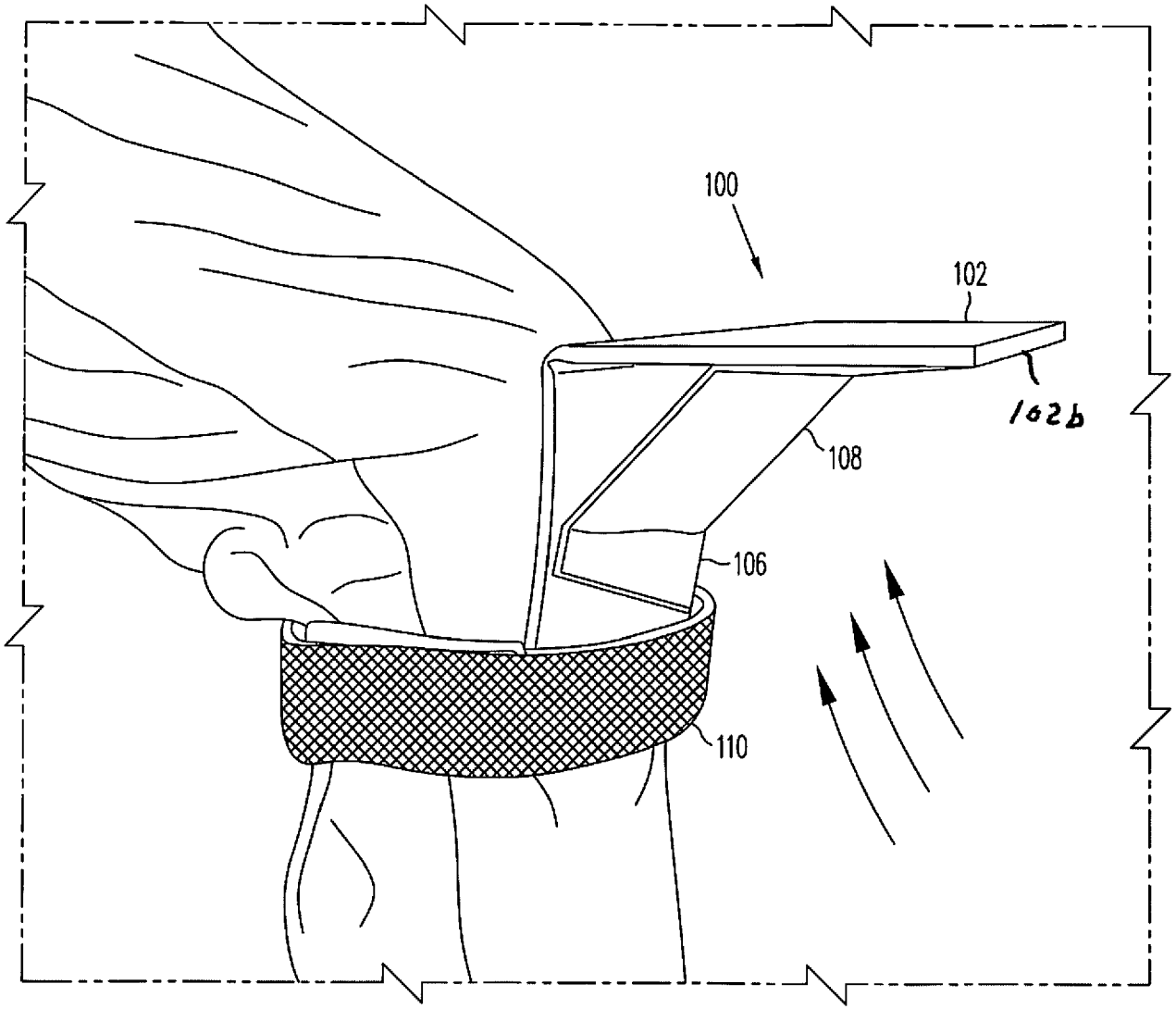
FIG. 11 is a view of the embodiment of FIG. 10 showing the deflector in its extended condition.
Figure 12:
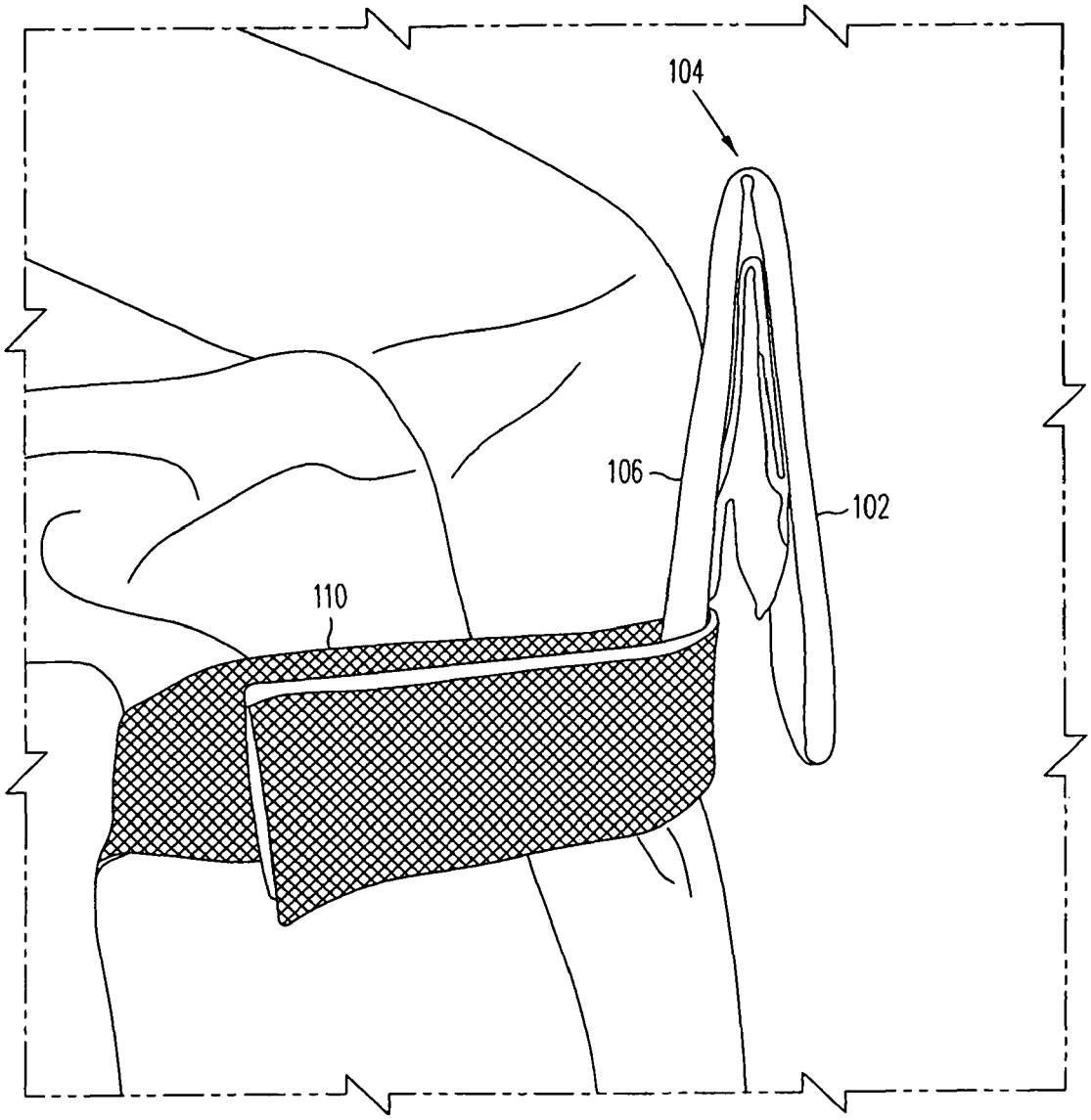
FIG. 12 is a view of the embodiment of FIG. 10 showing the deflector in its collapsed condition.

FIGS. 10-12 show another embodiment of a deflector according to the invention that collapses when not in use. As shown in FIG. 10, deflector 100 includes a pivotable deflector plate 102, a hinge mechanism 104, a mounting plate 106 and a flexible support web 108. Deflector plate 102 has a free end 102*b* and a second end 102*a*. Mounting plate 106 has a free end 106*b* and a second end 106*a*. The second end 102*a* of deflector plate 102 and the second end 106*a* of mounting plate 106 are connected by the hinge mechanism 104. Mounting plate 106 is attached to a strap 110. A Velcro pad 110*a* at one end of strap 110 mates with a Velcro pad 110*b* on the other side of strap 110 to attach deflector 100 to the rider's leg. In other embodiments, strap 110 could be secured with snaps, buckles or other mechanisms, in place of or in addition to Velcro.

FIG. 11 shows deflector 100 strapped to the leg of a rider while the motorcycle is moving. As shown by the arrows, the air flow forces deflector 100 upward into its extended condition, with support web 108 in tension. In this embodiment, support web 108 is taut when the angle between deflector plate 102 and support plate is approximately 100 degrees. The free end 102*b* of deflector plate 102 extends forward from the knee of the rider when the deflector plate 102 is pivoted to the 100-degree angle with respect to the mounting plate 106. Strap 110 is wrapped around the rider's leg just below the kneecap to hold mounting plate 106 against the rider's leg. FIG. 12 shows deflector 100 in its collapsed condition when the motorcycle is not in motion.

In one embodiment, deflector 100 is constructed by wrapping a cloth material such as denim around internal plates to form deflector plate 102, mounting plate 106 and hinge mechanism 104. The cloth between deflector plate 102 and mounting plate 106 functions as the hinge mechanism 104. Support web 108 is also made of denim, and strap 110 is attached to mounting plate 106 by stitching or gluing. In other embodiments, leather, vinyl or other materials could be used in place of cloth, or the mounting and deflector plates and hinge mechanism could be made of entirety different materials.

As shown in FIG. 10, support web 108 is attached to mounting plate 106 along an edge 108*a* and to deflector plate 102 along an edge 108*b*. Support web 108 is trapezoidal in shape, and edges 108*a* and 108*b* are attached at acute angles to the side edges of mounting plate 106 and deflector plate 102, respectively, such that support web 108 tends to push the air flow outward around the outside of the rider's leg. Edges 108*a* and 108*b* in this embodiment function as lines of attachment between support web 108 and mounting plate 106 and deflector plate 102, respectively. It will be understood that there are numerous other ways of constructing deflector 100. Moreover, although deflector plate 102 and mounting plate 106 are shown as planar in FIGS. 10-12, they may be contoured or shaped in various ways. Although support web 108 is shown as a single piece of material, it may be perforated in various ways or may comprise one or more strands of a tensile member such as string, cord or wire.

The embodiments of this invention described above are illustrative and not limiting. Many different and alternative embodiments will be apparent from the above descriptions. For example, while the deflectors described above are mounted to the motorcyclist's leg by means of a strap, it is also possible to mount the deflector by sewing it or otherwise attaching it to the motorcyclist's pants. The following claims are to be interpreted broadly to include all such alternative embodiments.

I claim:

1. An air deflector mountable to the knee of a motorcycle rider, the air deflector comprising a deflector plate and a mounting plate, each of the deflector plate and the mounting plate having a free end and a second end, the second end of the deflector plate and the second end of the mounting plate being connected by a hinge mechanism, the hinge mechanism allowing the deflector plate to pivot with respect to the mounting plate, a support web being connected to the deflector plate and mounting plate to prevent the deflector plate from pivoting with respect to the mounting plate beyond a predetermined angle, wherein the free end of the deflector plate extends forward exclusively from the knee of the motorcycle rider when the deflector plate is pivoted to the predetermined angle with respect to the mounting plate.

2. The air deflector of claim 1 further comprising a strap attached to the mounting plate, the strap being wrapped around a leg of the rider.

3. The air deflector of claim 2 wherein the strap is wrapped around the leg of the rider at a location just below the knee.

4. The air deflector of claim 1 wherein the support web is attached to the deflector plate along a first line of attachment and to the mounting plate along a second line of attachment, the first line of attachment forming a first acute angle with a side edge of the deflector plate, the second line of attachment forming a second acute angle with a side edge of the mounting plate.

5. The air deflector of claim 1 wherein the hinge mechanism comprises cloth material.

6. The air deflector of claim 1 wherein the support web comprises cloth material.

7. An air deflector for a motorcycle rider, the air deflector comprising a deflector plate and a mounting plate, the mounting plate being sized and shaped so as to permit the mounting plate to be held firmly just below the knee of the motorcycle rider, each of the deflector plate and the mounting plate having a free end and a second end, the second end of the deflector plate and the second end of the mounting plate being connected by a hinge mechanism, the hinge mechanism allowing the deflector plate to pivot with respect to the mounting plate, a support web being connected to the deflector plate and mounting plate to prevent the deflector plate from pivoting with respect to the mounting plate beyond a predetermined angle, wherein the free end of the deflector plate extends forward exclusively from the knee of the motorcycle rider when the deflector plate is pivoted to the predetermined angle with respect to the mounting plate.

8. The air deflector of claim 7 further comprising a strap attached to the mounting plate.

9. The air deflector of claim 7 wherein the support web is attached to the deflector plate along a first line of attachment and to the mounting plate along a second line of attachment, the first line of attachment forming a first acute angle with a side edge of the deflector plate, the second line of attachment forming a second acute angle with a side edge of the mounting plate.

10. The air deflector of claim 7 wherein the hinge mechanism comprises cloth material.

11. The air deflector of claim 7 wherein the support web comprises cloth material.

* * * * *